United States Patent [19]

Kanno

[11] 4,440,502

[45] Apr. 3, 1984

[54] ELECTRONIC TIMEPIECE

[75] Inventor: Fumio Kanno, Sayama, Japan

[73] Assignee: Citizen Watch Co., Ltd., Tokyo, Japan

[21] Appl. No.: 437,176

[22] Filed: Oct. 27, 1982

[30] Foreign Application Priority Data

| | | | |
|---|---|---|---|
| Oct. 27, 1981 | [JP] | Japan | 56-170826 |
| Jul. 20, 1982 | [JP] | Japan | 57-126147 |
| Jul. 28, 1982 | [JP] | Japan | 57-131842 |

[51] Int. Cl.[3] ..... G04B 19/04

[52] U.S. Cl. ..... 368/80; 368/157

[58] Field of Search ..... 368/66, 76, 80, 155–157, 368/160

[56] References Cited

U.S. PATENT DOCUMENTS

| | | | |
|---|---|---|---|
| 3,884,035 | 5/1975 | Jeannet et al. | 368/110 X |
| 4,266,288 | 5/1981 | Berney | 368/69 |

*Primary Examiner*—Vit W. Miska

*Attorney, Agent, or Firm*—Anthony H. Handal

[57] ABSTRACT

In an electronic timepiece having two stepping motors, one for driving at least a second-hand and the other for driving at least an hour-hand, rotation or non-rotation of the rotor of said other stepping rotor is detected and when non-rotation is detected, failure of stepping of said other stepping motor is determined and said one stepping motor is controlled to be actuated in a warning mode which is different from a normal mode to give warning of the failure of stepping of said other stepping motor.

6 Claims, 6 Drawing Figures

ELECTRONIC TIMEPIECE

BACKGROUND OF THE INVENTION

Field of the Invention

This invention relates generally to an electronic timepiece using stepping motors and more particularly to an electronic timepiece including two stepping motors, one for driving at least a second-hand and the other for driving at least a hour-hand.

In a general electronic timepiece with three hands that is a second-hand, a minute-hand and an hour-hand, these hands are driven by a single stepping motor. In such an electronic timepiece with three hands, the so-called electromagnetic time correction system, in which indicating positions of the hands are corrected by driving a stepping motor in accordance with a time correcting signal has not been adopted, because the system requires too long time for correction. However, the said electromagnetic correction system is inevitably adopted in order to realize analog electronic timepieces having additional functions besides mere time indicating function, such as a watch with a function for correcting difference in time and a watch with an alarming function in which the hour/minute-hands for indicating time serves also as a setting pointer of an alarm.

Recently, there has been proposed an electronic timepiece which has two stepping motors, one for driving the second-hand and the other for driving the hour/minute-hand to implement analog electronic timepieces having various functions.

For such a timepiece, since the second-hand and the hour/minute-hands each can independently be driven, the indicating position of the second-hand or the hour/-minute-hands can electromagnetically be corrected in a short time.

In such a timepiece, however, since each of two stepping motors is independently driven, there is also a possibility that even if the hour/minute-hands should stop for some cause, only the second-hand may continue its motion. In such a case, there is full of danger that a user of the timepiece may falsely assume that the timepiece is normally running and hence he may inadvertently mistake a false time indication for a correct time indication.

SUMMARY OF THE INVENTION

It is an object of the present invention to provide an electronic timepiece which can tell its user occurrence of abnormality in operation of the timepiece by controlling the movement of its second-hand in a manner different from normal. The electronic timepiece in accordance with the present invention is characterized by a detection circuit for detecting whether the stepping motor for driving at least the hour-hand is rotating (referred to as "rotation" hereinafter) or not (referred to as "non-rotation" hereinafter), and a control circuit for controlling the timepiece in such a way that when the detection circuit detects "non-rotation" of the rotor, the second-hand, in response to the detected result, moves in a manner different from normal.

BRIEF DESCRIPTION OF THE DRAWINGS

The present invention will be described with reference to the accompanying drawings in which.

DETAILED DESCRIPTION OF THE PREFERRED EMBODIMENTS

Figure 1:
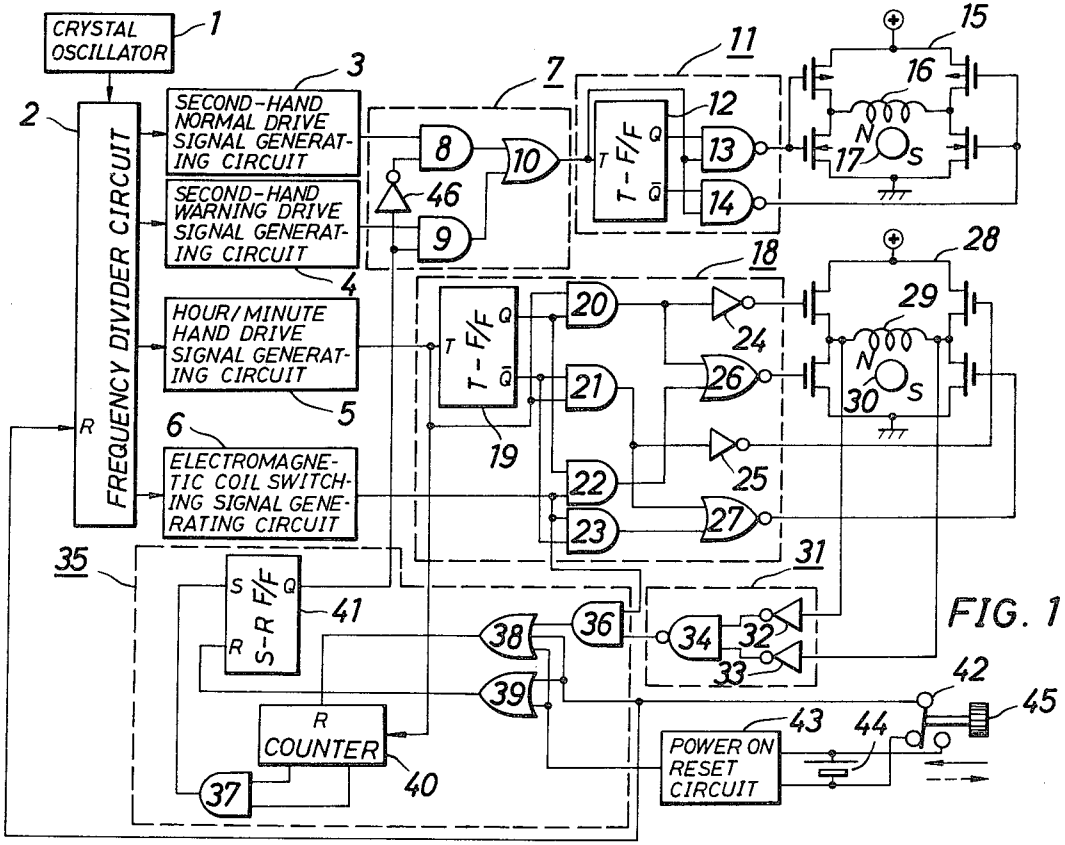
FIG. 1 shows a first embodiment of an electronic timepiece in accordance with the present invention.
Figure 2:
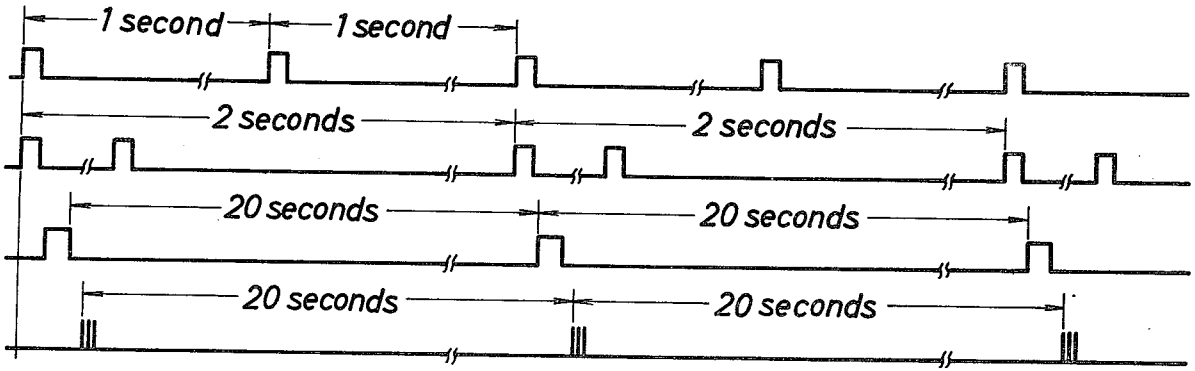
FIG. 2 shows signal waveform charts in the electronic timepiece shown in FIG. 1.

FIG. 1 is a circuit block diagram showing a first embodiment of an electronic timepiece in accordance with the present invention, and FIG. 2 shows signal waveform charts thereof. In FIG. 1, a crystal oscillator 1 is connected to a frequency divider circuit 2. A second-hand normal drive signal generating circuit 3 generates a second-hand normal-drive signal every second, as shown by a waveform in FIG. 2(A). A second-hand warning-drive signal generating circuit 4 generates two successive second-hand warning-drive signals every two seconds, as shown by a waveform in FIG. 2(B). An hour/minute-hand drive signal generating circuit 5 generates an hour/minute-hand drive signal every twenty seconds, as shown in a waveform in FIG. 2(C). An electromagnetic coil switching signal generating circuit 6 generates three successive narrow electromagnetic coil switching signals every twenty seconds, as shown by a waveform in FIG. 2(D).

The output signals of the second-hand normal-drive signal generating circuit 3, the second-hand warning-drive signal generating circuit 4, the hour-/minute-hand drive signal generating circuit 5, and the electromagnetic coil switching signal generating circuit 6, are produced in accordance with signals from proper output stages of the frequency divider circuit 2. Phases of the second-hand normal-drive signal and the hour/minute-hand drive signal are shifted from each other to reduce the load to a battery 44.

A selector circuit 7 which consists of AND gates 8 and 9 and an OR gate 10 is controlled by an output signal from a control circuit 35 as will be described hereinafter to selectively pass either the second-hand normal-drive signal or the second-hand warning-drive signal therethrough. A second-hand drive signal distributing circuit 11 consists of a toggle flip-flop 12 (referred to as T-FF hereinafter), and NAND gates 13 and 14. The input of T-FF 12 is connected to the output of OR gate 10 in the selector circuit 7; the inputs of NAND gate 13 are connected to the output of OR gate 10 and the output Q of T-FF 12; and the inputs of NAND gate 14 are connected to the output of OR gate 10 and the output $\overline{Q}$ of T-FF 12.

A driving circuit 15 for driving the second-hand consists of four MOS transistors, their inputs being connected to the outputs of NAND gates 13 and 14 and their outputs being connected to an electromagnetic coil 16 of a second driving stepping motor.

A second hand driving rotor 17, in conjunction with an electromagnetic coil 16 and a stator (not shown), constitutes a second-hand driving stepping motor. The rotor 17 rotates step by step each time the current flowing in the electromagnetic coil 16 is alternately changed in its direction, thereby driving the second-hand through a train of gear wheels (now shown).

An hour/minute-hand drive signal distributing circuit 18 consists of T-FF 19, AND gates 20, 21, 22 and 23, inverters 24 and 25, and NOR gates 26 and 27. The input of T-FF 19 is connected to the output of the hour/minute-hand drive signal generating circuit 5; one input of each of AND gates 20 and 21 is both connected to the output of the hour/minute-hand drive signal generating circuit 5, and the other inputs of AND gates 20 and 21 are respectively connected to the outputs Q and $\overline{Q}$ of T-FF 19; and one input of each of AND gates 22 and 23 is both connected from the output of the electromagnetic coil switching signal generating circuit 6, and the other inputs of AND gates 22 and 23 are respectively connected to the outputs Q and $\overline{Q}$ of T-FF 19. Furthermore, the input of the inverter 24 is connected from the output of AND gate 20; the inputs of NOR gate 26 are connected from the outputs of AND gates 20 and 22; the input of the inverter 25 is connected to the output of AND gate 21; and the inputs of NOR gate 27 are connected to the outputs of AND gates 21 and 23.

A driving circuit 28 for driving the hour/minute-hands consists of four MOS transistors, their inputs each being properly connected to the outputs of the inverters 24 and 25 and NOR gates 26 and 27, and their outputs being connected to an electromagnetic coil 29 of an hour/minute-hand driving stepping motor.

An hour/minute-hand driving rotor 30 in conjunction with the electromagnetic coil 29 and a stator (not shown), constitutes an hour/minute-hand driving stepping motor. The rotor 30 rotates step by step each time the current flowing in the electromagnetic coil 29 is alternately changed in its direction, thereby driving the hour/minute-hands through a train of gear wheels (not shown). A detection circuit 31 for detecting the "rotation" or "non-rotation" of the rotor 30 consists of inverters 32 and 33 and a NAND gate 34, the outputs of the inverters 32 and 33 being connected to the input of NAND gate 34 and their inputs being connected across the electromagnetic coil 29.

A control circuit 35 consists of AND gates 36 and 37, OR gates 38 and 39, a scale-of-four counter (two-stage binary counter) 40, and a set-reset flip-flop 41 (referred to as S-RFF hereinafter). The inputs of AND gate 36 are connected to the output of NAND gate 34 and the output of the electromagnetic coil switching signal generating circuit 6; the inputs of OR gate 38 are connected from the output of the AND gate 36, a switch 42, and the output of a power-on reset circuit 43; and the input of the OR gate 39 are connected from switch 42 and the output of the power-on reset circuit 43. Additionally, the power-on reset circuit 43 is adapted to form one pulse signal only at an instance when a battery 44 has been inserted into the timepiece, while the switch 42 is connected to the negative terminal of the battery 44 because an external operating member 45 such as a crown is normally pushed in along the direction of a solid arrow.

Then, the input of the counter 40 is connected to the output of the hour-/minute-hand drive signal generating circuit 5 and the reset terminal R thereof is connected to the output of the OR gate 38; the inputs of the AND gate 37 are connected to two outputs of the counter 40; and the set terminal S of the S-RFF 41 is connected from the output of the AND gate 37, and the reset terminal R thereof is connected to the output of the OR gate 39. Furthermore, the output of the S-RFF 41 forming the output of the control circuit 35 is directly connected to the input of the AND gate 9 as well as to the input of the AND gate 8 through an inverter 46.

The operation of the first embodiment will now be described.

When the battery 44 is put into the timepiece, a pulse signal is generated from the power-on reset circuit 43, whereby the counter 40 and the S-RFF 41 are reset and the outputs of the counter 40 and the S-RFF 41 each become a signal "L". In addition, at this time, the switch 42 is connected to the negative terminal of the battery 44 because the external operating member 45 is pushed in along the direction of the solid arrow. Thus the second-hand normal-drive signal as shown in FIG. 2(A) passes through the selector circuit 7 and serves to rotate the rotor 17 every second through the second-hand drive signal distributing circuit 11, the driving circuit 15, and the electromagnetic coil 16. Thus, the second-hand is driven through a train of gear wheels to effect the normal movement of one step per second (normal mode).

On the other hand, an hour/minute-hand drive signal per twenty seconds as shown in FIG. 2(C) is generated from the hour/minute-hand drive signal generating circuit 5, so that the rotor 30 is driven every twenty seconds through the hour/minute-hand drive signal distributing circuit 18, the driving circuit 28, and the electromagnetic coil 29, whereby the hour/minute-hands are driven through a train of gear wheels to effect their respective movement.

When a short time elapses after the application of the hour/minute-hand drive signal, an electromagnetic coil switching signal is applied to the driving circuit 28. At this time, the rotation of the rotor 30 causes an induced voltage to be generated at one end of the electromagnetic coil 29. This induced voltage will exceed the threshold voltage of the inverter 32 or 33 if the rotor 30 rotates normally, and will not exceed the threshold voltage of the inverter 32 or 33 if the rotor 30 does not rotate or is in "non-rotation".

Since this principle of operation is already disclosed in Japanese Patent Public Disclosure No. 21966/53, the detailed description is omitted here.

The operation will now be described with respect to the case where the rotor 30 has rotated normally. When the rotor 30 rotates normally, a voltage above the threshold voltage is applied to one of the inverters 32 and 33, and hence the outputs either of the inverter 32 or 33 will become a signal "L" and the outputs of the NAND gate 34 will become a signal "H". Therefore, the counter 40 is reset through the AND gate 36 and the OR gate 38, the output of the S-RFF 41 keeps on holding the signal "L". Thus, the second-hand is driven in accordance with the second-hand normal-drive signal. Thus, in the case where the hour/minute-hand driving rotor 30 rotates normally, the second hand performs the normal movement.

Then, assuming that the rotor 30 could not normally rotate for some causes such as impact, dust, low temperature and magnetic field, even if the electromagnetic coil switching signal should be applied to the driving circuit 28, no voltage exceeding the threshold voltage of the inverter 32 or 33 is generated from one end of the electromagnetic coil, and no signal "H" is generated from the NAND gate 34. So, the counter 40 is not reset and then the counter 40 starts counting the hour/minute-hand drive signal to provide the signals "L" and "H". However, at this time, the S-RFF 41 is not yet reset and the output of the S-RFF 41 holds the signal "L", whereby for next twenty seconds the second-hand performs the normal movement of one step per second. Although after twenty seconds the next hour/minute drive signal is applied to the driving circuit 28, the rotor 30 is out of phase relative to a new hour/minute drive signal, because it could not normally rotate last time, and hence it cannot normally rotate also this time.

Accordingly, even if the electromagnetic coil switching signal should be applied to the driving circuit 28, no voltage exceeding the threshold voltage of the inverters 32 and 33 is generated and hence the counter 40 is not reset.

Thus, the counter 40 counts the hour/minute-hand drive signal to provide the signals "H" and "L". However, also this time the output of the S-RFF 41 keeps on holding the signal "L", and also for another twenty seconds, the second-hand still performs the normal movement of one step per second (normal mode). Then, after twenty seconds, the counter 40 will now count the hour/minute-hand drive signal to provide the signals "H" and "H". Thus, the S-RFF 41 is set, and the output of the S-RFF 41 is switched to and held at the H level. This condition never changes, even if the rotor 30 should return to its normal rotation afterward.

When the signal "H" comes out of the S-RFF 41, the second-hand warning-drive signal as shown in FIG. 2(B) passes through, whereby the second-hand performs two successive step movement per two seconds different from the normal movement of the hand. In this manner, if the rotor 30 fails to normally rotate three times successively, then the second-hand comes to perform the two successive step movement per two seconds (abnormal mode or warning mode), even if the rotor 30 should return to its normal rotation afterward. Therefore, the user will notice that some abnormality has occured in the timepiece, thereby finding that the time indication is incorrect.

Then, the user pulls out the external operating member 45 in the direction of a dotted arrow to reset the hands. Then, for example, if the external operating member 45 is turned, a correction signal is applied from a time correction signal generating circuit (not shown) to the driving circuit 28, whereby the rotor 30 rotates to perform resetting of the hands. At this time, the switch is connected to the positive terminal of the battery 44, so that the counter 40 and the S-RFF 41 are reset, and the output of the s-RFF 41 is switched to and held at the L level. The frequency divider circuit 2 is also reset.

When the external operating member 45 is pushed in along the direction of the solid arrow after the hands are reset to a correct time, the switch 42 is again connected to the nagative terminal of the battery 44, and also the reset of the frequency divider circuit 2 is cancelled. Accordingly, from the next step, the second hand begins to effect the normal movement of one step per second (normal mode).

While in the above described embodiment, the circuit is arranged in such a way that when it is determined that the rotor 30 of the hour/minute-hand driving stepping motor is in "non-rotation" three times successively, the operating condition of the second-hand is changed, it may also be arranged in such a way that the operating condition of the second-hand is changed by detecting the "non-rotation" of the rotor 30 only once.

An second embodiment of this case will now be described, in which the operation described above is achievable only by changing part of the arrangement of the control circuit 35 shown in FIG. 1.

Figure 3:
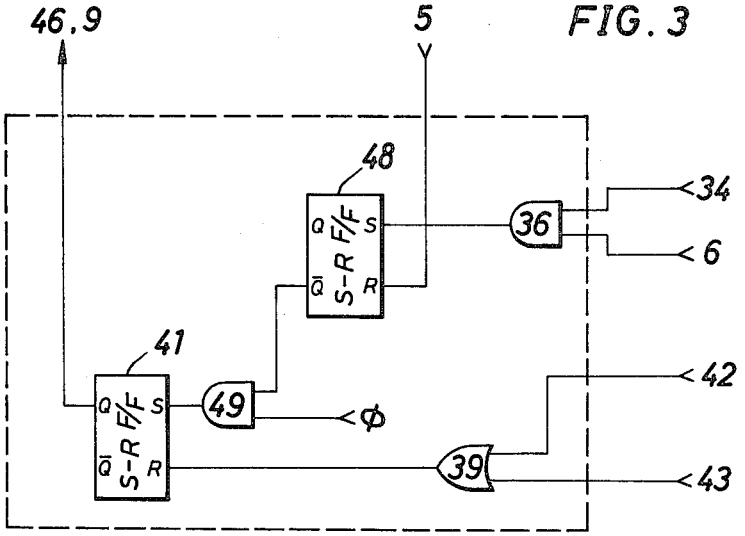
FIG. 3 shows a variation of the control circuit in the embodiment shown in FIG. 1.

FIG. 3 shows a control circuit corresponding to the control circuit 35 shown in FIG. 1 which circuit consists of AND gates 36 and 49, and S-RFF 41 and 48. This configuration differs from FIG. 1 in that the output of the AND gate 49 which receives the output signal of the output $\overline{Q}$ of the S-RFF 48 and a clock signal $\phi$ as shown in FIG. 4(E) as inputs thereof becomes a set signal for the S-RFF 41. Additionally, in FIG. 3 gates having functions similar to those shown in FIG. 1 have like reference numerals similar to FIG. 1. Furthermore, FIGS. 4(A), (B), (C) and (D) are identical to those in FIG. 2.

In operation, during the time when the rotor 30 normally rotates and "rotation" is being detected, since the output signal of the output $\overline{Q}$ of the S-RFF 41 is the signal "L" at the time the above clock signal $\phi$ as shown in FIG. 4(E) is to be supplied, the AND gate never provides the signal "H". Therefore, the output signal of the output Q of the S-RFF 41 is held at the L level, and the normal stepwise movement of the second-hand one step per second, is performed.

If the "non-rotation" of the rotor 30 is now detected, the output signal on the output Q of the S-RFF 48 is held at the H level at the time the clock signal $\phi$ is to be supplied. Therefore, since at the time the clock signal is to be applied to the AND gate 49 the signal "H" is derived from the AND gate 49, the S-RFF 41 is inverted into the set state, and the output signal of its output Q is switched to and held at the H level. In other words, in this embodiment, as soon as possible the "non-rotation" of the rotor 30 is detected, the operating condition of the second-hand is changed.

In addition, at the time when the battery has been inserted into the timepiece and after the crown has been manipulated, the operation of the circuit is similar to FIG. 1.

As is apparent from the above description, for the electronic timepiece in accordance with the present invention, if the hour/minute-hands stop for some cause, the second-hand effects the movement different from the normal stepwise movement, so that it is also prevented that the user takes a false time indication for a correct one.

Additionally, the circuit may be arranged in such a manner that after the correction of the hands has been performed by manipulating the external operating member, the second hand effects the normal stepwise movement automatically.

Figure 5:
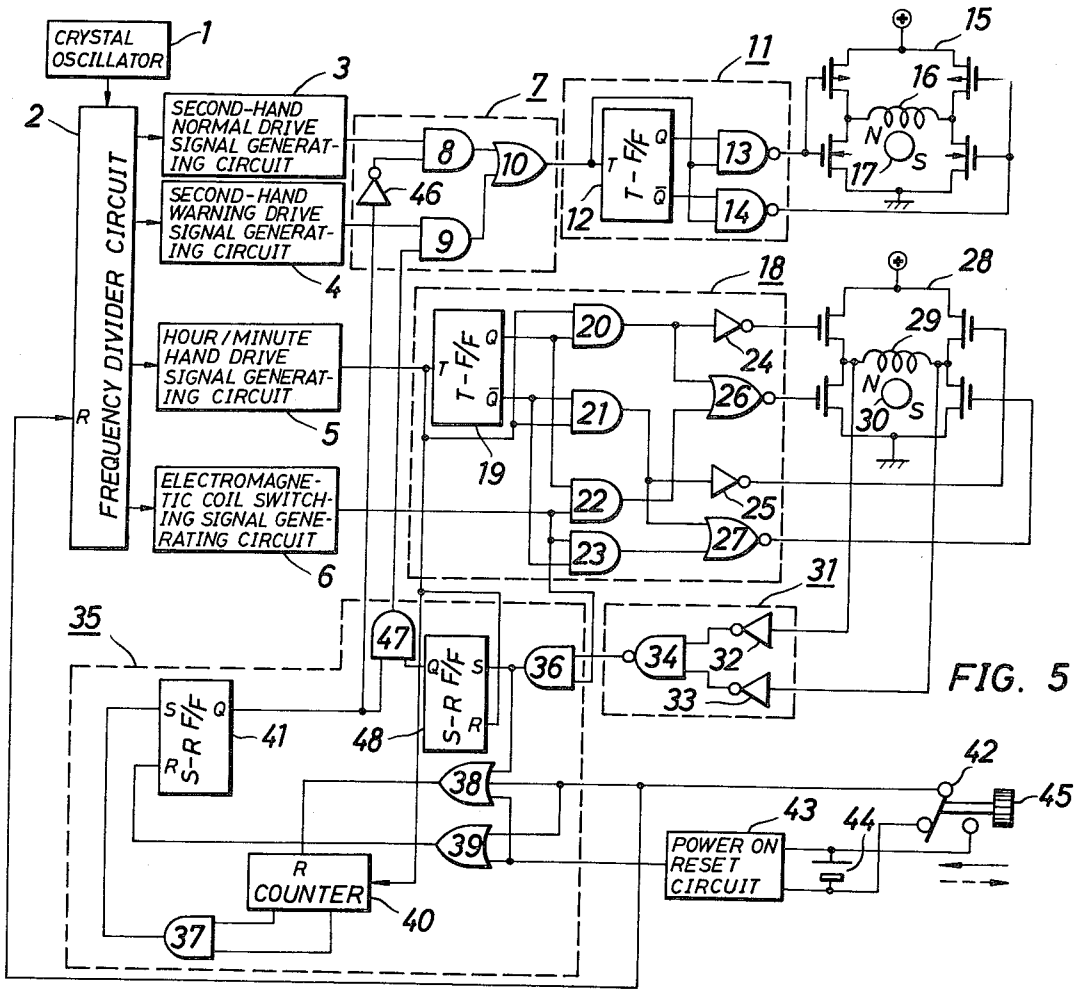
FIG. 5 shows a second embodiment in accordance with the present invention.

On the other hand, while in the above described embodiments, all the circuits arranged so that if the hour/minute-hands temporarily stop, the operating condition of the second-hand is controlled so as to take the condition of movement different from normal movement, it is not necessarily required to arrange the circuit, for example, as an embodiment as shown in FIG. 5, an arrangement is possible in which the temporary stop of the hour/minute-hands is signaled by stopping the second hand.

FIG. 5 is a block diagram showing a circuit arrangement of an electronic timepiece in accordance with the second embodiment of the present invention. In FIG. 5, elements except for a selector circuit 7 and a control circuit 35 are identically constituted to those shown in FIG. 1, so that they will not be described herein.

The selector circuit 7 in the second embodiment consists of AND gates 8 and 9 and an OR gate 10, said circuit being controlled by an output signal from a control circuit 35, as will be described hereinafter, thereby taking a condition for selectively passing either the second hand normal-drive signal or the second-hand warning-drive signal therethrough or preventing the passage of both signals. Furthermore, a control circuit 35 in the second embodiment consists of AND gates 36, 37 and 47, OR gates 38 and 39, a scale-of-four counter 40, and a set-reset flip-flops 41 and 48 (referred to as S-RFF hereinafter). The inputs of the AND gate 36 are connected to the output of the NAND gate 34 and the output of the electromagnetic coil switching signal generating circuit 6; the inputs of the OR gate 38 are connected to the output of the AND gate 36, a switch 42, and the output of a power-on reset circuit 43; and the inputs of the OR gate 39 are connected to the switch 42 and the output of the power-on reset circuit 43.

Next, the input of the counter 40 is connected to the output of the hour/minute-hand drive signal generating circuit 5, and the reset terminal R thereof is connected to the output of the OR gate 38; the inputs of the AND gate 37 are connected from two outputs of the counter 40; and the set terminal S of the S-RFF 41 is connected to the output of the AND gate 37, and the reset terminal R thereof is connected to the output of the OR gate 39.

Furthermore, the set terminal S of the S-RFF 48 is connected to the output of the AND gate 36, the reset terminal R thereof is connected to the output of the hour/minute-hand drive signal generating circuit 5, and the input of the AND gate 47 is connected to the outputs Q of the S-RFFs 41 and 48.

Furthermore, the output Q of the S-RFF 41 providing the output of the control circuit 35 and the output of the AND gate 47 are respectively connected to the inputs of the inverter 46 and the AND gate 9 in the selector circuit, and further the output of the inverter 46 is connected to the input of the AND gate 8.

Now, the operation of the second embodiment will be described.

Additionally, also in this embodiment, the signal waveform charts shown in FIG. 2 as described above are applied.

When the battery 44 is initially switched on, a pulse signal is generated from the power-on reset-circuit 43, whereby the counter 40 and the S-RFF 41 are reset and the outputs of the counter 40 and the S-RFF 41 each becomes a signal "L". In addition, at this time, the switch 42 is connected to the negative terminal of the battery 44, because the external operating member 45 is pushed in along the direction of the solid arrow. Thus the second-hand normal-drive signal as shown in FIG. 2(A) passes through the selector circuit 7 and serves to rotate the rotor 17 every second through the second-hand drive signal distributing circuit 11, the driving circuit 15, and the electromagnetic coil 16. Thus, the second-hand is driven through a train of gear wheels to effect the normal movement of one step per second (normal mode).

On the other hand, an hour/minute-hand drive signal per twenty seconds as shown in FIG. 2(C) is generated from the hour/minute-hand drive signal generating circuit 5, so that the rotor 30 is driven every twenty seconds through the hour/minute-hand drive signal distributing circuit 18, the driving circuit 28, and the electromagnetic coil 29, whereby the hour/minute-hands are driven through a train of gear wheels to effect their respective movement.

When a short time elapses after the application of the hour/minute-hand drive signal, an electromagnetic coil switching signal is applied to the driving circuit 28. At this time, the rotation of the rotor 30 causes an induced voltage to be generated at one end of the electromagnetic coil 29. This induced voltage will exceed the threshold voltage of the inverter 32 or 33 if the rotor 30 rotates normally, and will not exceed the threshold voltage of the inverter 32 or 33 if the rotor 30 does not rotate or is in "non-rotation".

The operation will not be described with respect to the case where the rotor 30 has rotated normally. When the rotor 30 rotates normally, a voltage above the threshold voltage is applied to one of the inverters 32 and 33, and hence either of the inverters 32 and 33 provides a signal "L" and the NAND gate 34 provides a signal "H". Therefore, the S-RFF 48 is set through the AND gate 36 and also the counter 40 is reset through the AND gate 36 and the OR gate 39, the output Q of the S-RFF 41 keeps on holding the signal "L".

Consequently, the output of the AND gate 47 is held at the L level, the AND gates 7 and 8 are respectively controlled to be in ON state and OFF state, whereby the second-hand is driven in accordance with the second-hand normal-drive signal. Thus, in the case where the hour/minute-hand driving rotor 30 rotates normally, the second-hand performs the normal movement.

Then, assuming that the rotor could not normally rotate for some causes such as impact, dust, low temperature, and magnetic field, even if the electromagnetic coil switching signal should be applied to the driving circuit 28, no voltage exceeding the threshold voltage of the inverter 32 or 33 is generated from one end of the electromagnetic coil, and no signal "H" is generated from the NAND gate 34. So, the counter 40 is not reset and the counter 40 is counted by the hour/minute-hand drive signal to provide the signals "L" and "H". However, at this time, the S-RFF 41 is not yet reset and the output Q of the S-RFF 41 holds the signal "L", whereby for next twenty seconds the second-hand performs the normal movement of one step per second. Although after twenty seconds the next hour/minute drive signal is applied to the driving circuit 28, the rotor 30 is out of phase relative to the new hour/minute drive signal because it could not normally rotate last time, and hence it cannot normally rotate also at this time.

Accordingly, even if the electromagnetic coil switching signal should be applied to the driving circuit 28, no voltage exceeding the threshold voltage of the inverters 32 and 33 is generated and hence the counter 40 is not reset.

Thus, the counter 40 is counted by the hour/minute-hand drive signal to output the signals "H" and "L". However, also this time the output Q of the S-RFF 41 keeps on holding the signal "L", and also for another twenty seconds, the second-hand performs the normal movement of one step per second. Then, after twenty seconds, the counter 40 will now count the hour/minute-hand drive signal to provide the signals "H" and "H". Thus, the S-RFF 41 is set, and the output Q of the S-RFF 41 is switched to and held at the H level. This condition never changes even if afterward the rotor 30 should return to its normal rotation.

On the other hand, the rotor 30 of the hour/minute-hand driving stepping motor is rotating normally, the output Q of the S-RFF 48 becomes the signal "H", because the S-RFF 48 is being set by the signal "H" from the AND gate 36 (but the output Q temporarily becomes the signal "L" due to the reset signal supplied from the signal generating circuit 5 every twenty seconds), and the output Q of the S-RFF 41 is being held at the L level, whereby the AND gate 47 provides the signal "H". In contrast to this, when the rotor 30 loses its normal rotation, the set signal is not applied to the S-RFF 48 from the AND gate 36 and the output Q of the S-RFF 48 will be retained at the L level.

Thus, when the rotor 30 does not rotate normally and the output signal of the output Q of the S-RFF 41 is switched and retained at the signal "H", as described above, both the AND gates 7 and 8 become the OFF state, and hence the second-hand normal-drive signal and the second-hand warning-drive signal both cannot pass through the select gate 7 and the second-hand stops.

Thereafter, the rotor 30 again begins its normal rotation, the output Q of the S-RFF 48 is inverted to the H level (the output Q temporarily becomes the L level by the reset signal), and the output signal of the AND gate 47 becomes the signal "H". Then, the AND gate 9 now becomes ON state, and the second-hand warning-drive signal passes through the select gate 7, whereby the second-hand begins the quick stepwise movement of two steps per two seconds. In this manner, if the rotor fails to normally rotate three times successively, the second hand stops, and if the rotor afterward begins the normal rotation again, then the second hand begins to effect the quick stepwise movement of two steps per two seconds. Therefore, the user will notice that some abnormality has occurred in the timepiece, thereby finding that the time indication is incorrect.

Then, the user pulls out the external operating member 45 in the direction of a dotted arrow to reset the hands. Then, for example, if the external operating member 45 is turned, a correction signal is applied from a time correction signal generating circuit (not shown) to the driving circuit 28, whereby the rotor 30 rotates to perform resetting of the hands. At this time, the switch is connected to the positive terminal of the battery 44, so that the counter 40 and the S-RFF 41 is reset, and the output Q of the S-RFF 41 is switched to an held at the L level. The frequency divider circuit 2 is also reset.

When the external operating member 45 is pushed in along the direction of the solid arrow after the hands are reset to a correct time, the switch 42 is again connected to the negative terminal of the battery 44, and also the reset of the frequency divider circuit 2 is also cancelled.

Therefore, from the next step, the second-hand begins to effect the normal one step movement every second.

While in the above described embodiment, the circuit is arranged in such a way that when it is determined that the rotor 30 of the hour/minute-hand driving stepping motor is in "non-rotation" three times successively, driving of the second-hand is stopped, it may also be arranged in such a way that the driving of the second-hand is stopped by detecting the non-rotation of the rotor 30 only once.

An embodiment for this case will now be described, in which the operation as described above is achievable only by changing part of the arrangement of the control circuit 35 shown in FIG. 5.

Figure 4:
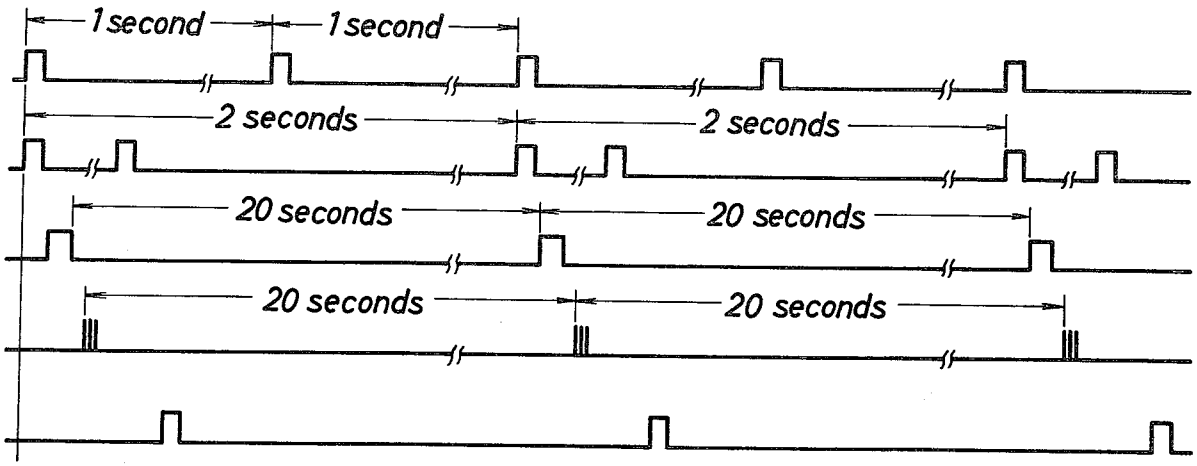
FIG. 4 shows signal waveform charts in the electronic timepiece having the modified control circuit shown in FIG. 3.
Figure 6:
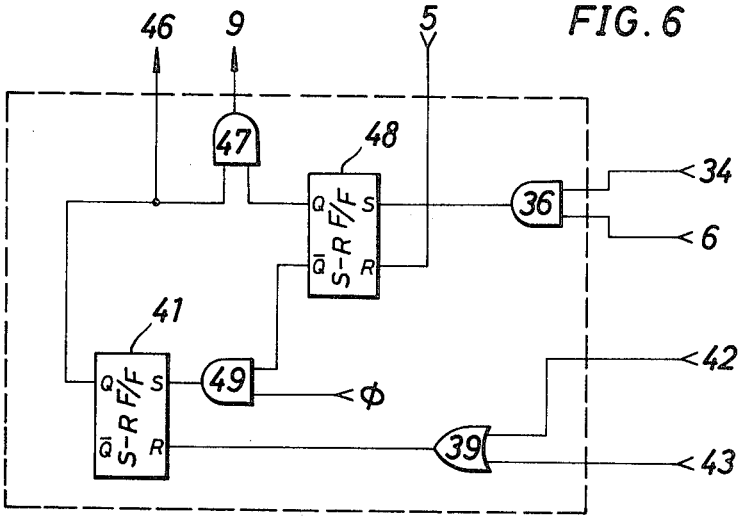
FIG. 6 shows a variation of the control circuit of the second embodiment shown in FIG. 5.

FIG. 6 shows a control circuit corresponding to the control circuit 35 shown in FIG. 5, which circuit consists of AND gates 36, 47 and 49, S-RFFs 41 and 48. This configuration differs from FIG. 5 in that the output of the AND gate 49 which receives the output of the output Q of the S-RFF 48 and a clock signal $\phi$ as shown in FIG. 4(E) as inputs thereof becomes a set signal for the S-RFF 41. Additionally, in FIG. 6 gates having functions similar to those shown in FIG. 5 have similar reference numerals similar to FIG. 5. Furthermore, with respect to the second embodiment, signal waveform charts in FIG. 4 are applied.

In operation, during the time when the rotor 30 normally rotates and "rotation" is being detected, since the output signal of the output $\overline{Q}$ of the S-RFF 41 is the signal "L" at the time the above clock signal $\phi$ as shown in FIG. 4(E) is to be supplied, the AND gate never provides the signal "H". Therefore, the normal stepwise movement of the second-hand one step per second, comes to a stop. Since at this time, the output signal of the output Q of the S-RFF 48 has been the signal "L", it is apparent that the quick stepwise movement of the second-hand for two seconds is not performed.

In other words, as soon as the "non-rotation" of the rotor 30 is detected, driving of the second-hand is stopped. Thereafter, the "rotation" of the rotor 30 is again detected and the output signal of the output of the S-RFF 48 becomes the signal "H", whereby the output signal becomes the signal "H" and the quick stepwise movement of the second-hand two steps per two seconds begins to be performed.

In addition, at the time the battery has been inserted into the timepiece and after the crown has been manipulated, the operation of the circuit is similar to FIG. 5.

As is apparent from the above description, for the electronic timepiece in accordance with the present invention, if the hour/minute-hands stop for some cause, the seconds-hand stops, so that it is also prevented that the user takes a false time indication for a correct one.

Additionally, the circuit may be arranged in such a manner that after the correction of the hands has been performed by manipulating the external operating member, the second hand effects the normal stepwise movement automatically.

While the present invention has been described with reference to the preferred embodiments thereof, it will be understood that any modification may be made within the scope of the following claims. For example, a minute-hand may be driven not by the second stepping motor, but by the first stepping motor.

What I claimed is:

1. In an electronic timepiece powered by a battery and having time indicating hands, the improvement comprising:

a first stepping motor including a first electromagnetic coil and a first rotor for driving at least a seconds-hand;

a second stepping motor including a second electromagnetic coil and a second rotor for driving at least an hours-hand;

a means for judging failure of stepping of said second rotor of said second stepping motor; and a controlling means responsive to the output of said judging means for causing said first stepping motor to be actuated in a warning mode different from the normal mode to give warning of the failure of stepping of said second rotor of said second stepping motor.

2. An electronic timepiece according to claim 1, wherein said controlling means is adapted to cause said seconds-hand to make an abnormal motion by controlling the signal for driving said first stepping motor in response to the output of said judging means to give warning of the failure of stepping of said second rotor of said second stepping motor.

3. An electronic timepiece according to claim 1, wherein said controlling means is adapted to stop the motion of said seconds-hand by inhibiting the drive of said first stepping motor in response to the output of said judging means to give warning of the failure of stepping of said second rotor of said second stepping motor.

4. An electronic timepiece according to claim 3, wherein said controlling means including a control circuit for causing said second-hand to make an abnormal motion by controlling the signal for driving said first stepping motor when said judging means detects the success of the stepping of said second stepping motor again after said judging means once detected the failure of stepping of said second stepping motor.

5. An electronic timepiece according to claim 1, further comprising an external operating means to provide a switching signal to return said first stepping motor into the normal mode from said warning mode when actuated.

6. An electronic timepiece according to claim 1, wherein a minute-hand is adapted to be driven by said second stepping motor.

* * * * *